US006864872B2

(12) United States Patent
Yang

(10) Patent No.: US 6,864,872 B2
(45) Date of Patent: Mar. 8, 2005

(54) DRIVING METHOD OF BIAS COMPENSATION FOR TFT-LCD

(75) Inventor: Chien-Sheng Yang, Taipei (TW)

(73) Assignee: AU Optronics Corp, Hsinchu (TW)

( * ) Notice: Subject to any disclaimer, the term of this patent is extended or adjusted under 35 U.S.C. 154(b) by 250 days.

(21) Appl. No.: 10/127,907

(22) Filed: Apr. 22, 2002

(65) Prior Publication Data

US 2002/0158860 A1 Oct. 31, 2002

(30) Foreign Application Priority Data

Apr. 25, 2001 (TW) ..... 90109870 A

(51) Int. Cl.[7] ..... G09G 3/36
(52) U.S. Cl. ..... 345/94
(58) Field of Search ..... 345/92, 94, 95, 345/96, 97, 99; 349/33, 34, 42

(56) References Cited

U.S. PATENT DOCUMENTS 5,398,043 A * 3/1995 Takeda et al. ..... 345/94
5,986,631 A * 11/1999 Nanno et al. ..... 345/94
5,995,074 A * 11/1999 Kusafuka et al. ..... 345/90
6,005,542 A * 12/1999 Yoon ..... 345/92
6,198,464 B1 * 3/2001 Ota et al. ..... 345/77
6,317,113 B1 * 11/2001 Wu ..... 345/92

* cited by examiner

*Primary Examiner*—Chanh Nguyen
*Assistant Examiner*—Paul A. Bell
(74) *Attorney, Agent, or Firm*—Ladas & Parry LLP

(57) ABSTRACT

An object of the present invention is to provide a driving method of bias compensation for thin-film-transistor liquid-crystal-display (TFT-LCD) comprising the following steps: during a positive field period, applying a first low-level gate voltage to drive a gate line; wherein the first low-level gate voltage has a first waveform, the LCD voltage is fully charged at the beginning of the positive field period and partially discharged at the end of the positive field period to have a first voltage vibration amplitude; during a negative field period, applying a second low-level gate voltage to drive the gate line; wherein the second low-level gate voltage has a second waveform, the LCD voltage is fully recharged at the beginning of the negative field period and partially discharged at the end of the negative field period to have a second voltage vibration amplitude. By adjusting the first and the second waveforms, the root-mean-square of the LCD voltage during the positive field period is approximately equal to the root-mean-square of the LCD voltage during the negative field period.

6 Claims, 5 Drawing Sheets

DRIVING METHOD OF BIAS COMPENSATION FOR TFT-LCD

BACKGROUND OF THE INVENTION

1. Field of the Invention

The present invention relates in general to a control technology for liquid crystal display (LCD). In particular, the present invention relates to a bias compensating driving method to minimize display flicker in LCDs.

2. Description of the Related Art

FIG. 1 is an equivalent circuit diagram of a conventional thin-film-transistor liquid-crystal-display (TFT LCD). As shown in FIG. 1, the TFT-LCD comprises scanning electrodes (or gate lines, represented as G1, G2 . . . Gx) and data electrodes (D1, D2, D3 . . . Dy). The two types of electrodes intersect with each other. Each intersection point of the scanning electrodes and the data electrodes controls an individual display unit. For example, the scanning electrode G1 and the data electrode D1 control the display unit 100. As shown in FIG. 1, the equivalent circuit of the display unit 100 comprises a thin film transistor 10, a liquid crystal capacitor Clc comprising a display electrode, a common electrode, and a storage capacitor Cs. The gate of the thin film transistor 10 is coupled to the scanning electrode G1 and the drain of the thin film transistor 10 is coupled to the data electrode D1. The data is written to the display unit 100 via the data electrodes by controlling the state of the thin film transistor 10 with the scanning electrode G1. The scan driver 3 sends scanning signals according to scanning control data to drive the scanning electrodes G1, G2, G3 . . . Gx sequentially so that only the thin film transistors of a selected scanning electrode are on at a time interval, the thin film transistors of the other (X−1) rows of the electrodes are kept off. When the thin film transistors of the selected row are on, the data driver 2 sends the corresponding video signals (Grey scale values) to the y display units on the scanning electrode via the date electrodes D1, D2, D3 . . . Dy, according to display video data. After all the x rows of the scanning electrodes are scanned and driven, the frame is completely displayed. The scanning procedure is repeated and the video signals are transmitted for the image to display.

The display frequency of a conventional LCD is about 60 Hz (60 frames per second). Each scanning electrode Gj ($1 \leqq j \leqq x$) is scanned every 16.67 ms to allow all its thin film transistors to be sequentially activated.

The characteristics of thin film transistors are shown in FIG. 2. The time interval of t1–t3(and t3–t5) is 16.67 ms. It is assumed that VCOM is 0, and the voltage on the liquid crystal capacitor Clc is the liquid crystal display voltage VLc.

Referring to FIG. 2, in the time interval between t1~t2, the high-level gate voltage Vgh opens all the thin film transistors on row j of the scanning electrode. The video data (a positive voltage signal with respect to VCOM at the present) is sent through the data electrodes Di ($1 \leqq i \leqq y$) as video data (grey scale values) to the display units on row j of the scanning electrode and recharges the liquid crystal capacitor Clc of each display unit with a positive voltage. The LCD voltage VLc thus increases gradually.

At the time interval t2~t3, the low-level gate voltage Vg1 of the scanning electrode VGj closes all the thin film transistors of the display units on row j of the scanning electrode. Because of leakage of thin film transistors, the LCD voltage VLc drops gradually toward 0V, until the temporal point t3 when the LCD voltage VLc reaches a first voltage value V1.

At the time interval of t3~t4, the high-level gate voltage of the scanning signal VGj opens all the thin film transistors on the display units on row j of the scanning electrode. The display video data (now being negative voltage signal with respect to VCOM) is sent as the video signal (Grey scale values)through the corresponding data electrodes Di ($1 \leqq i \leqq y$) to the corresponding display units on row j of the scanning electrode and recharges the LCD capacitor Clc with a negative voltage. Consequently, the LCD voltage value VLc is negative with increased value. At the interval t4~t5, the low-level gate voltage Vg1 of the scanning signal VGj closes all the thin film transistors of the display units on row j of the scanning electrode. The LCD voltage VLc, due to leakage of the thin film transistors declined toward 0V to become a second voltage value V2 at the timing point t5.

The time interval t2~t3 is usually referred to as the positive field period, and the interval t4~t5 is referred to as the negative field period. The leakage current of the thin film transistors are different in the positive and the negative field periods because of the voltage differences between the gate and the source Vgs at the two periods. Thus, the first voltage value V1 and the second voltage value V2 are different. With respect to the root-mean-square, rms of the LCD voltage, VLc, the rms of the LCD voltages during the positive and the negative filed periods, the difference between the two results in the change in light transmittance. The result is display flicker with a frequency of 30 Hz.

SUMMARY OF THE INVENTION

An object of the present invention is to provide a driving method of bias compensation for thin-film-transistor liquid-crystal-display (TFT-LCD) comprising the following steps: during a positive field period, applying a first low-level gate voltage to drive a gate line; wherein the first low-level gate voltage has a first waveform, the LCD voltage is fully charged at the beginning of the positive field period and partially discharged at the end of the positive field period to have a first voltage vibration amplitude; during a negative field period, applying a second low-level gate voltage to drive the gate line; wherein the second low-level gate voltage has a second waveform, the LCD voltage is fully recharge at the beginning of the negative field period and partially discharged at the end of the negative field period to have a second voltage vibration amplitude. Wherein by adjusting the first and the second waveforms, the root-mean-square of the LCD voltage during the positive field period is approximately equal to the root-mean-square of the LCD voltage during the negative field period.

An example of the adjustment method is to let the first waveform of the first low-level gate voltage comprise a fixed voltage waveform and an alternating voltage waveform, and let the second waveform of the second low-level gate voltage be a fixed voltage waveform. The reverse configuration allows the first waveform of the first low-level gate voltage be a fixed voltage waveform, and the second waveform of the second low-level gate voltage comprise a fixed voltage waveform and an alternating voltage waveform. Ultimately, it is proposed to let the first waveform of the first low-level gate voltage comprise a fixed voltage waveform and an alternating voltage waveform, and the second waveform of the second low-level gate voltage comprise a fixed voltage waveform and an alternating voltage waveform.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

The First Embodiment

Figure 1:
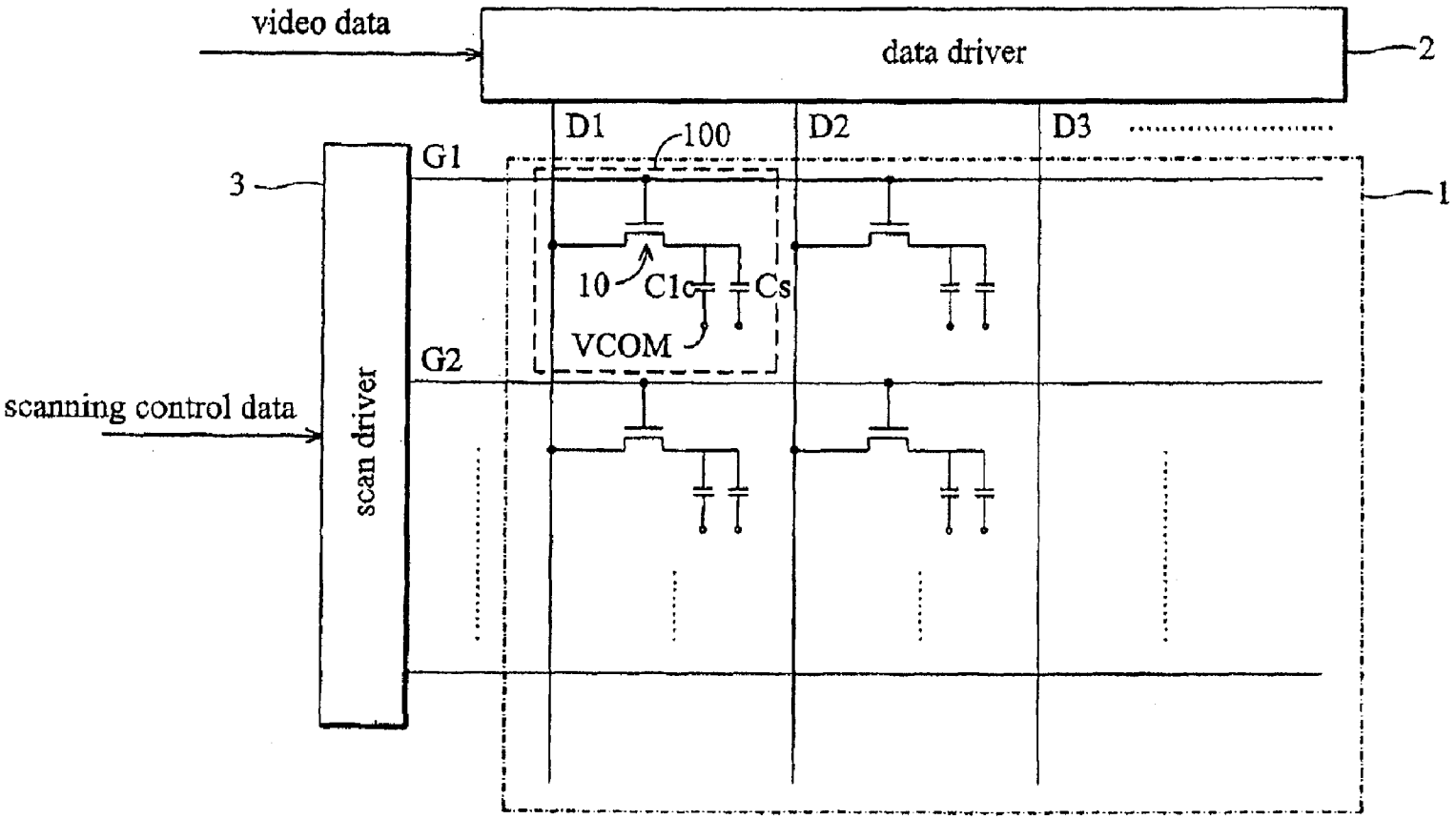
FIG. 1 ( PRIOR ART )
FIG. 1 is a perspective diagram of a conventional TFT-LCD.
Figure 2:
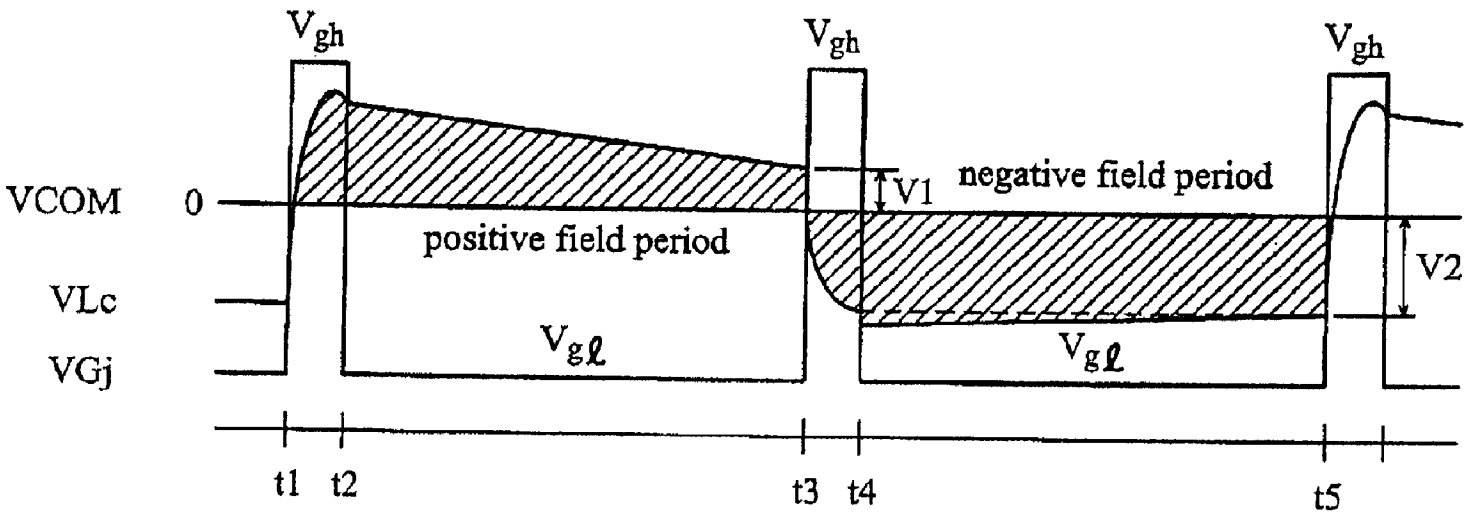
FIG. 2 ( PRIOR ART )
FIG. 2 is a characteristic diagram of a conventional FTF-LCD.
Figure 3:
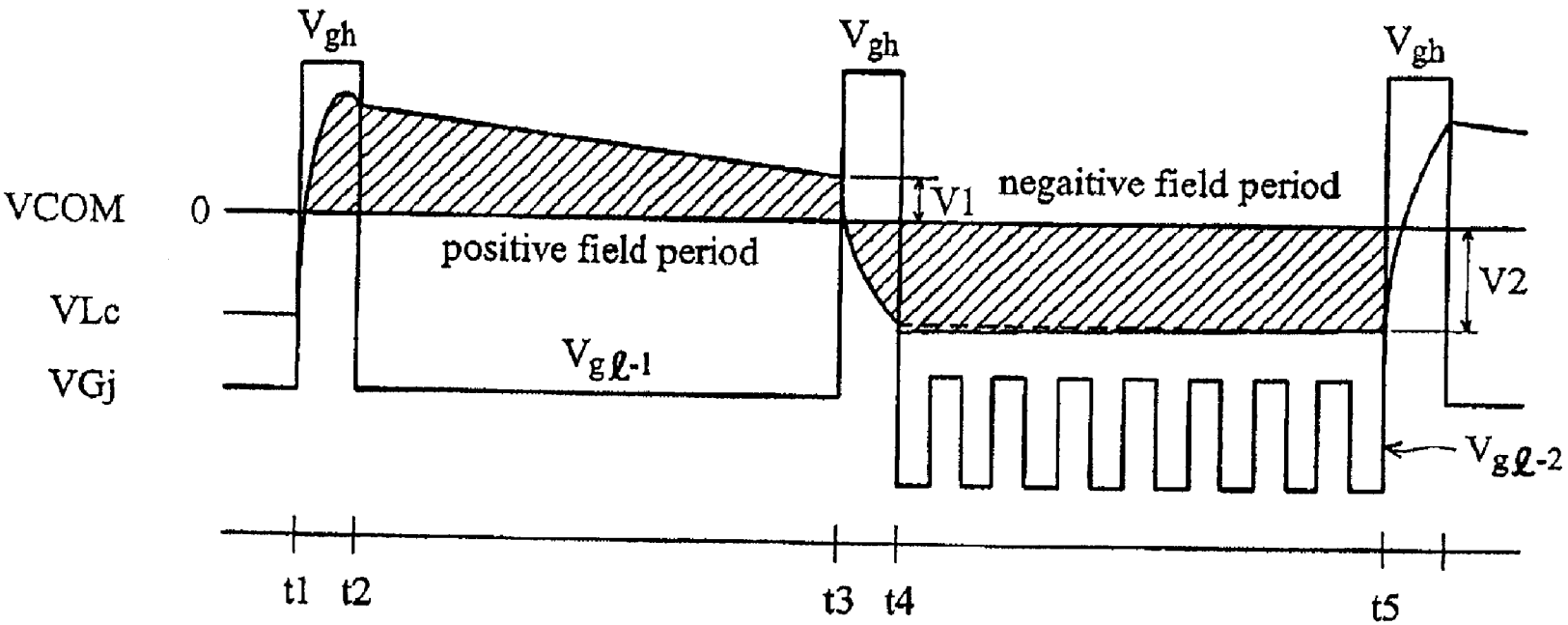
FIG. 3 is a characteristic diagram of an FTF-LCD according to the first embodiment of the present invention.

FIG. 3 shows the reduced leakage characteristics of the LCD-TFT of the first embodiment of the present invention. The present embodiment shows the driving mechanism of the j rows of the gate lines in FIG. 1 (scanning electrodes) driven by the scanning signal VGj. Similarly, the interval of t1~t2 (t3~t5) is 16.67 ms. It is also assumed that VCOM is 0V (but not limited to 0V only) and the voltage of the liquid crystal CLc is the liquid crystal display (LCD) voltage VLc.

Referring to FIG. 3, at the time interval t1~t2, the high-level gate voltage Vgh opens the thin film transistors of all the display units on row j of the scanning electrode, the display video data (as positive voltage signal relative to the VCOM voltage value) is sent through the data electrodes Di ($1 \leqq i \leqq y$) as the video signals to the corresponding display units on row j of the scanning electrode and recharges the liquid crystal capacitors Clc on each display unit. The LCD voltage VLc then is recharged and increases gradually until reaching a certain positive voltage value.

At the time interval t2~t3, the positive field period, the low-level gate voltage Vgl–1 of the scanning signal VGj is smaller than 0V (VCOM), the fixed reference voltage value, and closes the thin film transistors on all the display units of row j of the scanning electrodes. The LCD voltage VLc decreases toward 0V as discharge occurs due to leakage of the thin film transistors until the LCD voltage VLc at the time point t3 reaches a first voltage value (vibration amplitude) V1.

At the interval t3~t4, the high-level gate voltage Vgh of the scanning signal VGj opens the thin film transistors of all the display units on row j of the scanning electrode. The display video data (a negative voltage signal at the time being relative to VCOM) is sent as the video signal (grey scale signals) through the data electrodes Di ($1 \leqq i \leqq y$) to the corresponding display units to recharge the liquid crystal capacitors Clc on each display unit with negative voltages. Resultantly, the LCD voltage VLc gradually becomes larger in the negative voltage field until reaching a certain negative voltage value.

At the time interval t4~t5, the negative voltage period, the low-level gate voltage has a specified waveform comprising a fixed voltage and an alternating voltage. The thin film transistors on all the display units of row j of the scanning electrode are closed. However, due to leakage of the thin film transistors, the LCD voltage VLc decreases toward 0V. At the temporal point t5, the LCD voltage VLc reaches a second voltage (vibration amplitude) value V2.

In the present embodiment, due to the special configuration of the waveform of the low-level gate voltage Vgl_2, the voltage Vgs between the gate and the source is changed. The leakage of the thin film transistors is thereby rectified to let the first voltage value V1 become approximately equal to the second voltage value V2 so that the root-mean-square of the LCD voltage VLc during the positive voltage period is approximately equal to the LCD voltage VLc during the negative voltage period to minimize the display flicker.

The Second Embodiment

Figure 4:
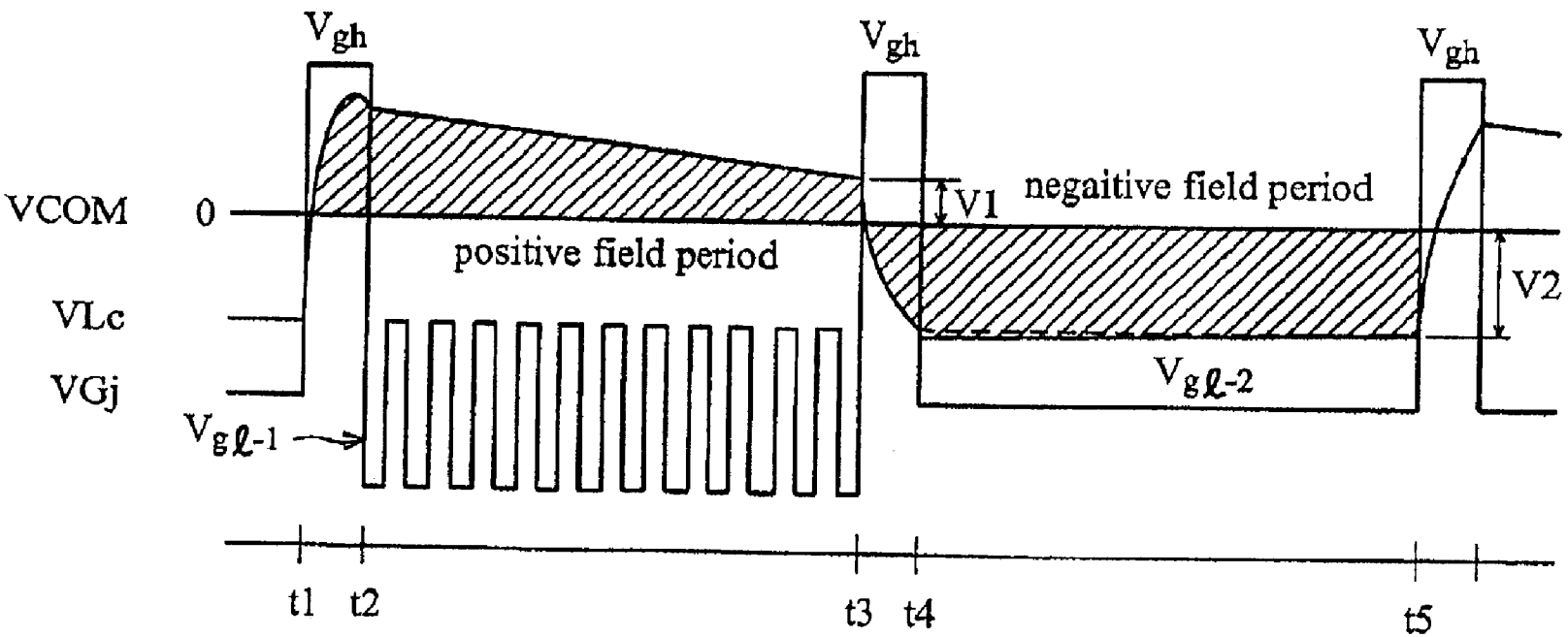
FIG. 4 is a characteristic diagram of an FTF-LCD according to the second embodiment of the present invention.

FIG. 4 shows the reduced leakage characteristics of the LCD-TFT of the second embodiment of the present invention. The present embodiment shows the driving mechanism of the j rows of the gate lines in FIG. 1(scanning electrodes) driven by the scanning signal VGj. Similarly, the interval of t1~t2 (t3~t5) is 16.67 ms. It is also assumed that VCOM is 0V (but not limited to 0V), and the voltage of the liquid crystal CLc is the liquid crystal display(LCD) voltage VLc.

Referring to FIG. 4, at the time interval t1~t2, the high-level gate voltage Vgh opens the thin film transistors of all the display units on row j of the scanning electrode, the display video data(as positive voltage signal relative to the VCOM voltage value) is sent through the data electrodes Di ($1 \leqq i \leqq y$) as the video signals to the corresponding display units on row j of the scanning electrode and recharges the liquid crystal capacitors Clc on each display unit. The LCD voltage VLc then is recharged and increases gradually until reaching a certain positive voltage value.

At the time interval t2~t3, the positive voltage period, the low-level gate voltage has a specified waveform comprising a fixed voltage and an alternating voltage. The thin film transistors on all the display units of row j of the scanning electrode are closed However, due to leakage of the thin film transistors, the LCD voltage VLc decreases toward 0V till the temporal point t3 that the LCD voltage VLc reaches a first voltage (vibration amplitude) value V1.

At the interval t3~t4, the high-level gate-voltage Vgh of the scanning signal VGj opens the thin film transistors of all the display units on row j of the scanning electrode. The display video data (being negative voltage signal at the time being relative to VCOM) is sent as the video signal (grey scale signals) through the data electrodes Di ($1 \leqq i \leqq y$) to the corresponding display units to recharge the liquid crystal capacitors Clc on each display unit with negative voltages. Resultantly, the LCD voltage VLc gradually becomes larger in the negative voltage field until reaching a certain negative voltage value.

At the time interval t4~t5, the negative field period, the low-level gate voltage Vgl-2 of the scanning signal VGj is smaller than 0V (VCOM), the fixed reference voltage value, and closes the thin film transistors on all the display units of row j of the scanning electrodes. The LCD voltage VLc decreases toward 0V as discharge occurs due to leakage phenomenon of the thin film transistors till the LCD voltage VLc at the time point t3 reaches a second voltage value (vibration amplitude) V2.

In the present embodiment, due to the special configuration of the waveform of the low-level gate voltage Vgl_1, the voltage Vgs between the gate and the source is changed. Leakage of the thin film transistors is thereby rectified to let the first voltage value V1 become approximately equal to the second voltage value V2, thus the root-mean-square of the LCD voltage VLc during the positive voltage period is approximately equal to the LCD voltage VLc during the negative voltage period as possible to minimize the display flicker.

The Third Embodiment

Figure 5:
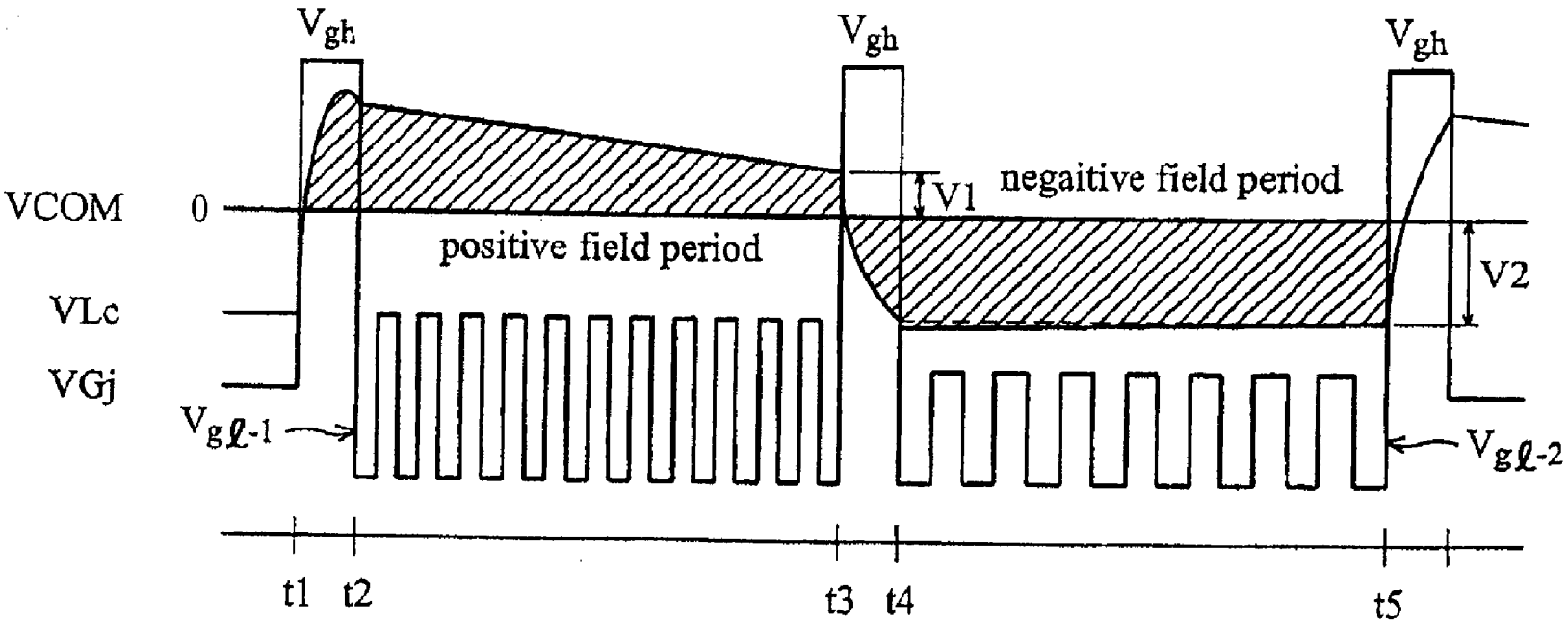
FIG. 5 is a characteristic diagram of an FTF-LCD according to the third embodiment of the present invention.

FIG. 5 shows the reduced leakage characteristics of the LCD-TFT of the third embodiment of the present invention. The present embodiment shows the driving mechanism of the j rows of the gate lines in FIG. 1 (scanning electrodes) driven by the scanning signal VGj. Similarly, the interval of t1~t2 (t3~t5) is 16.67 ms. It is also assumed that VCOM is 0V (but not limited to 0V), and the voltage of the liquid crystal CLc is the liquid crystal display(LCD) voltage VLc.

In the present embodiment, due to the special configuration of the waveform of the low-level gate voltages Vgl_1 and Vgl_2, the voltage Vgs between the gate and the source is changed to reduce the leakage of the thin film transistors in both the positive and negative field periods. As a result, the first voltage value V1 becomes approximately equal to the second voltage value V2 so that the root-mean-square of the LCD voltage VLc during the positive voltage period is roughly equal to the LCD voltage VLc during the negative voltage period to minimize the display flicker.

Finally, while the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A driving method of bias compensation for thin-film-transistor liquid-crystal-display (TFT-LCD) comprising the following steps: during a positive field period, applying a first low-level gate voltage to drive a gate line; wherein the first low-level gate voltage has a first waveform, the LCD voltage is fully charged at the beginning of the positive field period and partially discharged at the end of the positive field period to have: a first voltage vibration amplitude; and during a negative field period, applying a second low-level gate voltage to drive the gate line; wherein the second low-level gate voltage has a second waveform, the LCD voltage is fully recharged at the beginning of the negative field period and partially discharged at the end of the negative field period to have a second voltage vibration amplitude; wherein one of the first or second waveforms comprises a fixed voltage waveform with an alternating voltage waveform impressed thereon during at least a portion of the fixed voltage waveform, and wherein one of the first or second waveforms comprises a single constant fixed voltage only.

2. The method in claim 1, wherein by adjusting the first and the second waveforms, the root-mean square of the LCD voltage during the positive field period is approximately equal to the root-mean-square of the LCD voltage during the negative field period.

3. The method in claim 1, wherein the alternating voltage waveform is a square wave.

4. A driving method of bias compensation for thin-film-transistor liquid-crystal-display (TFT-LCD) comprising the following steps: during a positive field period, applying a first low-level gate voltage to drive a gate line; wherein the first low-level gate voltage has a first waveform, the LCD voltage is fully charged at the beginning of the positive field period and partially discharged at the end of the positive field period to have; a first voltage vibration amplitude; and during a negative field period, applying a second low-level gate voltage to drive the gate line; wherein the second low-level gate voltage has a second waveform, the LCD voltage is fully recharged at the beginning of the negative field period and partially discharged at the end of the negative field period to have a second voltage vibration amplitude; wherein a portion of the first waveform or a portion of the second waveform comprises a fixed voltage waveform with an alternating voltage waveform impressed thereon, and wherein one of the first or second waveforms comprises a single constant fixed voltage only.

5. The method in claim 4, wherein by adjusting the first and the second waveforms, the root-mean square of the LCD voltage during the positive field period is approximately equal to the root-mean-square of the LCD voltage during the negative field period.

6. The method in claim 4, wherein the alternating voltage waveform is a square wave.

* * * * *